US006012992A

United States Patent [19]

Yavitz

[11] Patent Number: 6,012,992

[45] Date of Patent: Jan. 11, 2000

[54] GOLF BALL HAVING A COVER WITH VARIABLE CHARACTERISTICS

[76] Inventor: Edward Q. Yavitz, 3828 Spring Creek Rd., Rockford, Ill. 61114

[21] Appl. No.: 09/248,621

[22] Filed: Feb. 11, 1999

[51] Int. Cl.[7] ..... A63B 37/12

[52] U.S. Cl. ..... 473/378; 473/353; 473/374; 473/377; 40/327; 273/DIG. 14

[58] Field of Search ..... 473/372, 373, 473/383, 384, 378, 377, 353, 374; 273/DIG. 14

[56] References Cited

U.S. PATENT DOCUMENTS

| | | | |
|---|---|---|---|
| 3,819,768 | 6/1974 | Molitor | 260/897 |
| 4,431,193 | 2/1984 | Nesbitt | 273/235 |
| 4,998,734 | 3/1991 | Meyer | 273/235 |
| 5,538,794 | 7/1996 | Cadorniga et al. | 428/407 |
| 5,542,680 | 8/1996 | Proudfit et al. | 473/378 |
| 5,631,324 | 5/1997 | Rajagopalan et al. | 473/385 |
| 5,783,293 | 7/1998 | Lammi | 473/373 |

*Primary Examiner*—George J. Marlo
*Attorney, Agent, or Firm*—Fletcher, Yoder & Van Someren

[57] ABSTRACT

A golf ball having a cover made from multiple materials. The golf ball includes a core and a cover disposed over the core. The cover includes a radially outer surface having at lest two distinct regions. Each of the regions includes a unique material having a unique material characteristic. Typically, the golf ball includes an opaque region and a transparent region disposed over an indicia, such as a logo, to provide an interesting visual effect.

20 Claims, 3 Drawing Sheets

GOLF BALL HAVING A COVER WITH VARIABLE CHARACTERISTICS

FIELD OF THE INVENTION

The present invention relates generally to a golf ball, and particularly to a golf ball having an improved cover in which one region of the cover may have different characteristics from another region of the cover.

BACKGROUND OF THE INVENTION

Golf balls generally comprise a resilient core that is surrounded by a cover. The core may be either a wound core or a solid core, and the cover is typically molded about the core. For example, the cover typically is either compression molded from two half shells or injection molded about the resilient core.

The covers of modern golf balls are made from a variety of materials, such as balata and ionomer resins, such as Surlyn™, a species of resins developed in the mid 1960's by E. I. DuPont De Nemours & Co. The balata material tends to be a softer material that provides the golfer with greater control of the golf ball, while Surlyn™ covers tend to be harder and less subject to nicks or cuts. Attempts have been made to develop certain hybrid covers having materials or blends that provide the feel and control afforded by a balata cover while maintaining a higher degree of durability, as with Surlyn™ covers.

Additionally, golf ball covers have been modified in a variety of ways by the addition of various logos or other markings. Some of these logos are simply stamped onto an exterior surface of the ball, but such logos are subject to nicking and marring during use. Attempts have also been made to locate logos or other markings within or beneath the cover. For example, golf balls have been manufactured by wrapping the core with a layer of material having desired markings and then providing a transparent Surlyn™ cover.

It would be advantageous to design a golf ball having a cover with different regions of unique material characteristics. For example, certain portions of the cover could be harder than others, or certain portions could be transparent while the other portions remain opaque. Such a design would provide flexibility in selection of materials to accommodate, for instance, logos disposed beneath the cover, while maintaining (over the remainder of the golf ball core) a material having optimal ball control characteristics.

SUMMARY OF THE INVENTION

The present invention features a golf ball. The golf ball comprises a core and a cover disposed over the core. The cover includes a first material and a second material alternately placed adjacent to each other. The first material and the second material each extend from the core to a radially outward surface of the cover.

According to another aspect of the invention, a golf ball includes a core, a visible indicia and a cover. The visible indicia is disposed proximate the core, and the cover is placed over or around the core. The cover includes a substantially transparent section over the visible indicia to allow viewing of the visible indicia.

According to another aspect of the invention, a golf ball includes a core and a cover disposed over the core. The cover includes an outer strike surface that is typically struck by a golf club head during play. The outer strike surface includes at least two distinct regions. Each distinct region includes a unique material characteristic to provide variable characteristics, e.g. transparent/opaque, hard/soft, in a single cover.

BRIEF DESCRIPTION OF THE DRAWINGS

The invention will hereafter be described with reference to the accompanying drawings, wherein like reference numerals denote like elements, and.

DETAILED DESCRIPTION OF THE PREFERRED EMBODIMENTS

Figure 1:
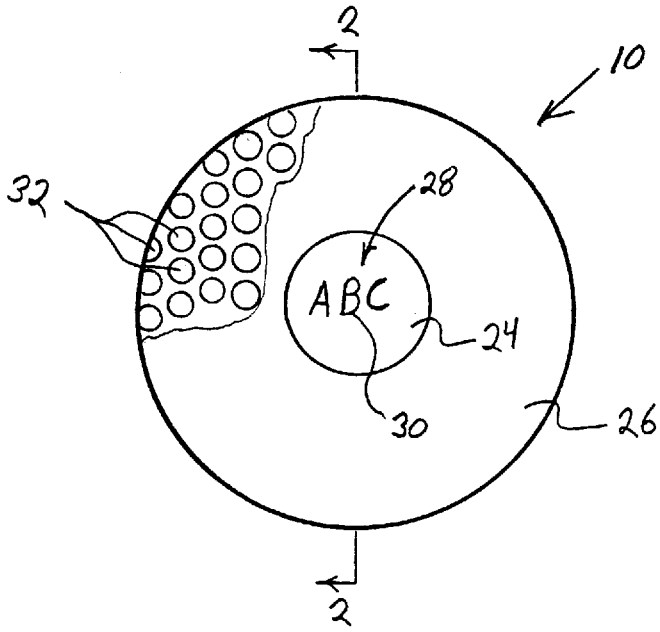
FIG. 1 is a front view of a golf ball, according to a preferred embodiment of the present invention.
Figure 2:
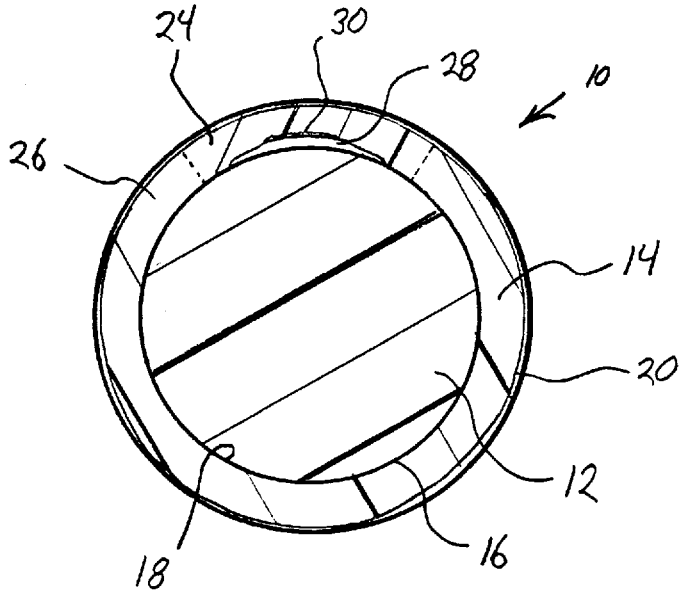
FIG. 2 is a cross-sectional view taken generally along line 2—2 of FIG. 1.

Referring generally to FIGS. 1 and 2, a golf ball 10 is illustrated according to a preferred embodiment of the present invention. Golf ball 10 includes a core 12 and a cover 14 disposed over core 12.

Core 12 may be a solid core or a wound core, as generally recognized by those of ordinary skill in the art. Regardless of the specific construction, core 12 includes an outer surface 16 about which cover 14 is disposed.

Cover 14, on the other hand, is formed around core 12 at a radially outlying position from core 12. Cover 14 includes an inner surface 18 that lies adjacent the core outer surface 16. Additionally, cover 14 includes a radially outward surface 20. An outer clear coating may be applied over radially outward surface 20.

Surface 20 is divided into distinct regions, such as a first region 24 and a second region 26. First region 24 and second region 26 may extend fully between radially outward surface 20 and core 12. Each of the distinct regions, e.g. first region 24 and second region 26, has a unique characteristic relative to the other region or regions. For example, first region 24 may be a transparent material and second region 26 may be an opaque material. Additionally, first region 24 may have a different hardness than the material of second region 26.

By way of specific example, first region may be transparent and made of a clear Surlyn™ material, while second region 26 is opaque and made from an opaque Surlyn™ material or a differing material, such as balata. Numerous combinations of material characteristics can be incorporated into the design of golf ball 10 depending on the desired end product.

In an exemplary, preferred end product, first region 24 is substantially transparent, e.g. clear Surlyn™, while second region 26 is opaque, e.g. white Surlyn™. An indicia 28 is disposed beneath radially outward surface 20 at first region 24. Indicia 28 may be disposed proximate outer surface 16 of core 12 and covered by first region 24 of cover 14. Because first region 24 is substantially transparent, the indicia 28 is visible from the exterior of the golf ball, and it is protected from striking or marring during play. Additionally, the curvature of cover 14 at first region 24 can provide an optically interesting effect with respect to indicia 28. An exemplary indicia 28 includes a logo 30, as illustrated best in FIG. 1.

As with conventional golf balls, golf ball 10 typically includes a plurality of dimples 32 impressed into cover 14.

However, in the subsequent Figures, the dimples are not shown to facilitate explanation of exemplary, alternate embodiments of golf balls formed according to the present invention.

Figure 3:
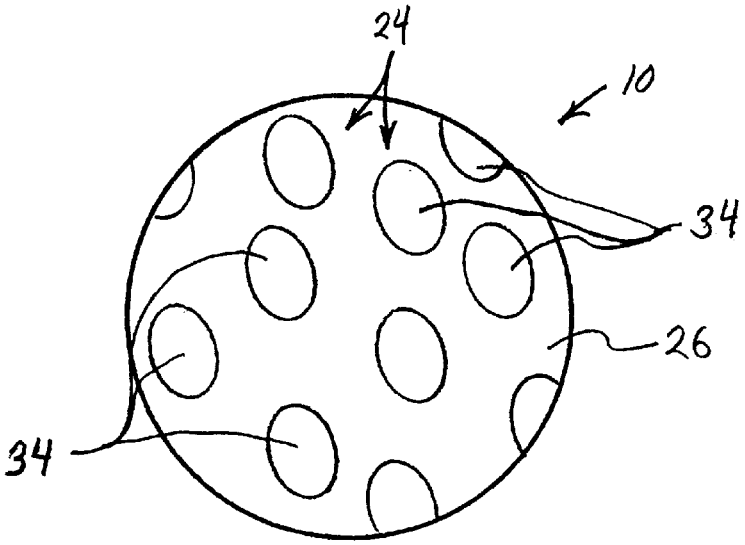
FIG. 3 is an alternate embodiment of the golf ball illustrated in FIG. 1.

Referring generally to FIG. 3, one alternate embodiment of golf ball 10 has first region 24 divided into a plurality of regions 34 distributed throughout second region 26. Regions 34 may be of varying size and/or varying materials and may be arranged symmetrically or asymmetrically. Additionally, multiple indicia 28 may be disposed beneath corresponding regions 34 when formed by a transparent or translucent material.

Figure 4:
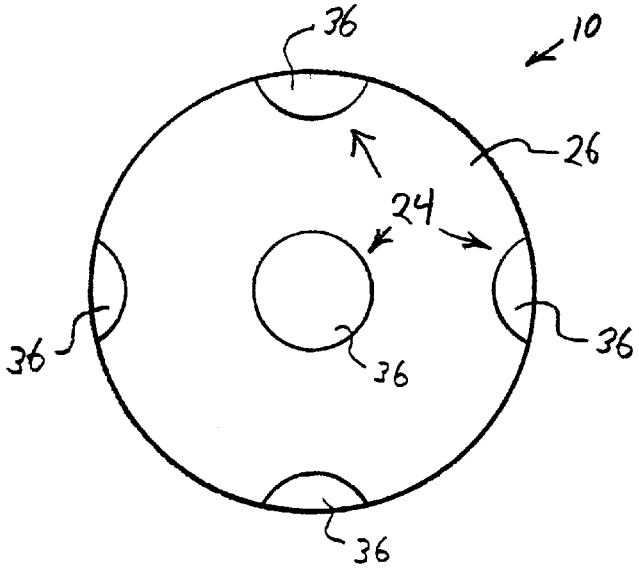
FIG. 4 is another alternate embodiment of the golf ball illustrated in FIG. 1.

Referring generally to FIG. 4, another alternate embodiment of golf ball 10 is illustrated in which first region 24 and second region 26 are arranged in a spherically symmetrical pattern. In this embodiment, first region 24 is divided into a plurality of circular regions 36 that are arranged in a spherically symmetrical pattern along radially outward surface 20. In the illustrated embodiment, there are six circular regions 36 arranged equidistant from one another.

Figure 5:
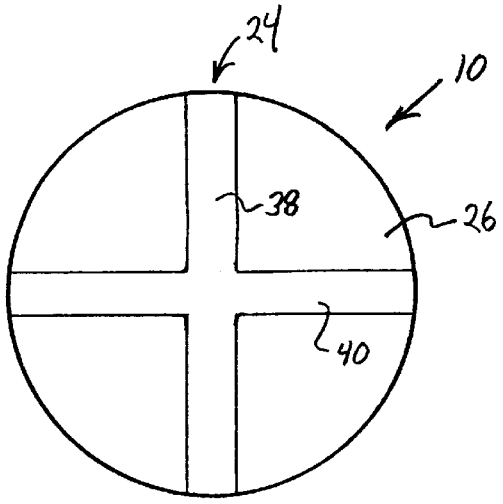
FIG. 5 is another alternate embodiment of the golf ball illustrated in FIG. 1.

Referring generally to FIG. 5, another alternate embodiment is illustrated. In this embodiment, first region 24 is arranged in a pair of strips 38 and 40 that each encircle golf ball 10 and cross one another at a generally perpendicular angle.

The embodiments described above are exemplary embodiments, and many other arrangements of two or more different regions can be utilized in the creation of cover 14. Typically, first region 24 covers fifty percent or less of radially outward surface 28, and may cover twenty percent or less, or even ten percent or less. For example, in the embodiment illustrated in FIG. 1, first region 24 may be made of a harder material such as generally transparent Surlyn™ exposed along approximately ten percent of radially outward surface 20. Second region 26, on the other hand, may be made of a softer material, such as balata, disposed along approximately ninety percent of radially outward surface 20. This arrangement not only allows the use of indicia 28 beneath radially outward surface 20, but it also provides the golfer with a selection of different striking surfaces when hitting off the tee box, or otherwise striking the golf ball. Alternatively, approximately ten percent of radially outward surface 20 can be formed from generally transparent Surlyn™ and the remaining ninety percent can be formed from a colored Surlyn™ Of course, the percentages can be varied according to a specific, preferred design.

First region 24 may be disposed in second region 26 in a variety of ways. For example, second region 26 may be injection molded around core 12, and cover 14 may be cut away at first region 24. The cover 14 can then be completed by filling the cut-away region with the second material by, for instance, injection molding the subject first region 24.

Figure 6:
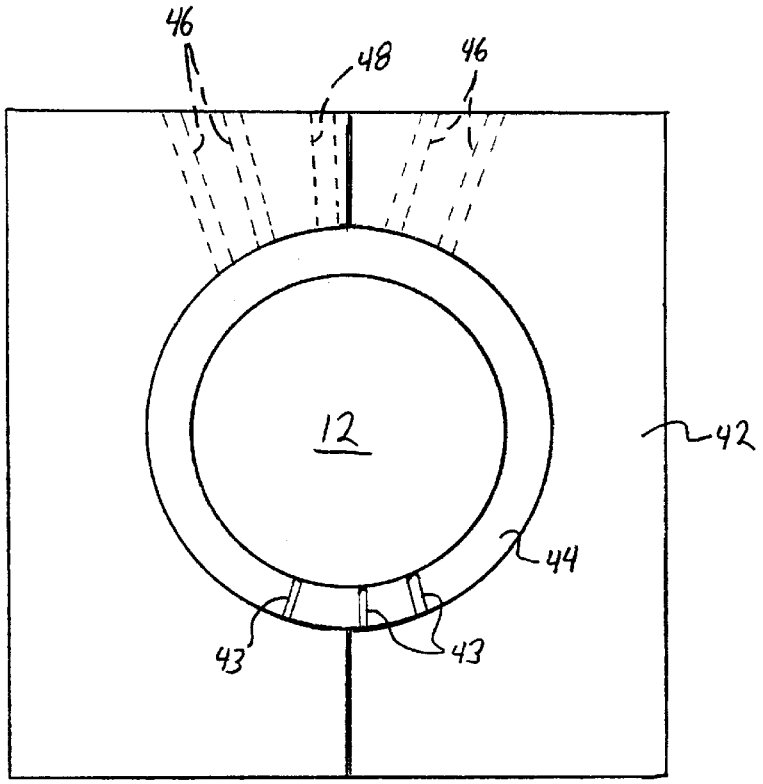
FIG. 6 is a schematic illustration of a system for injection molding a golf ball, according to a preferred embodiment of the present invention.
Figure 1:
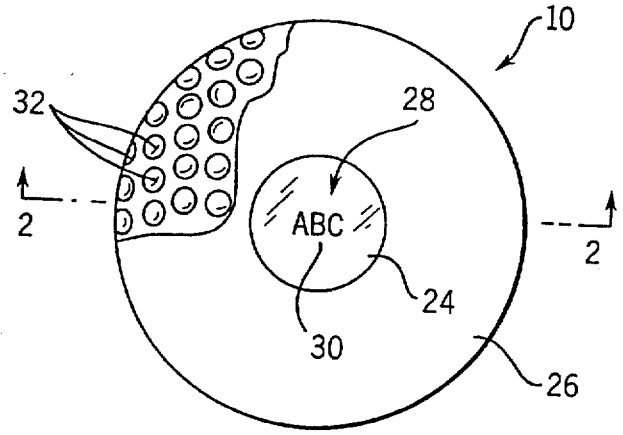
Figure 2:
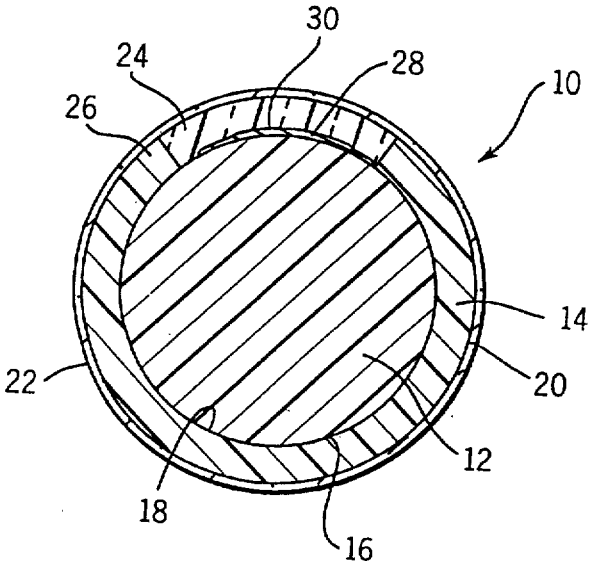
Figure 3:
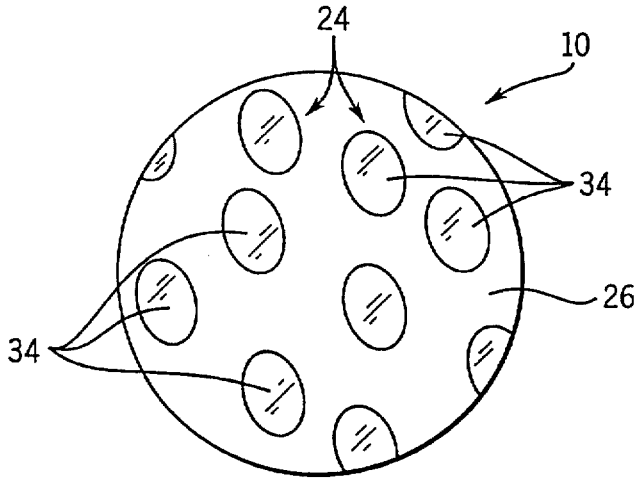
Figure 4:
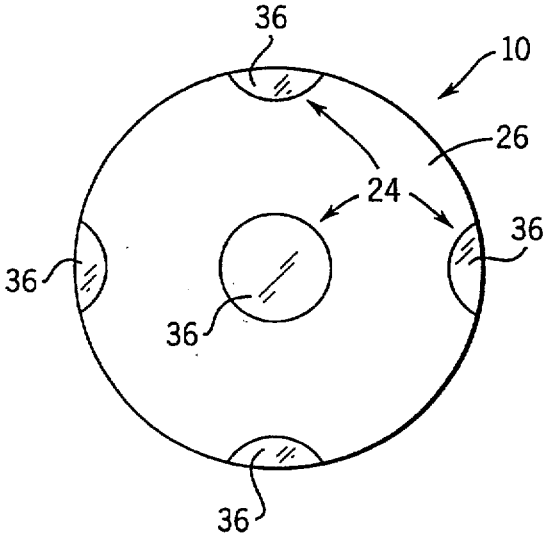
Figure 5:
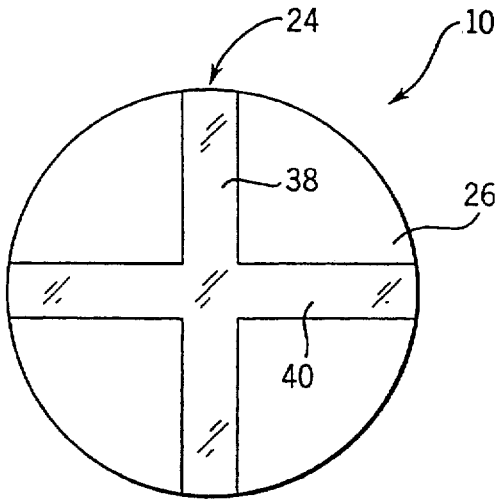
Figure 6:
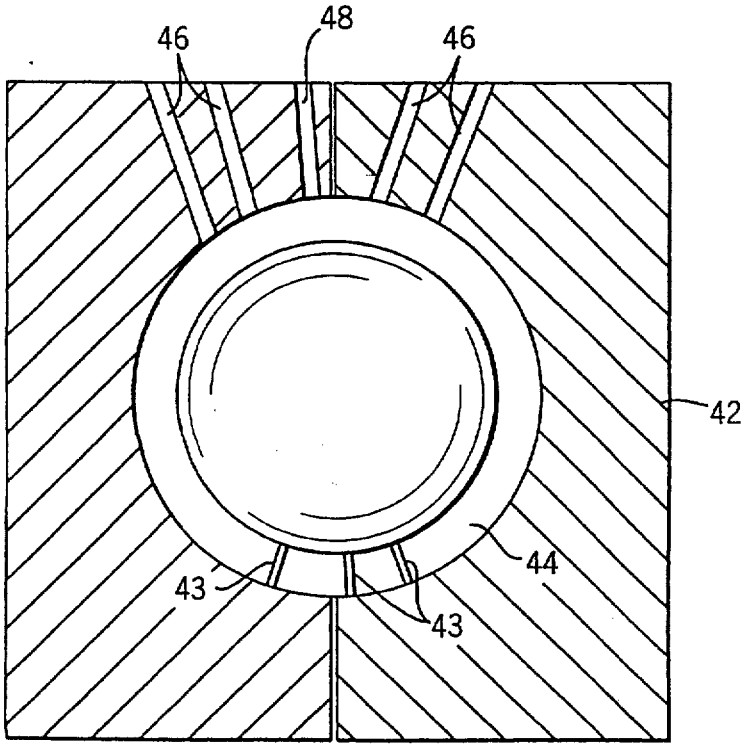

Also, first region 24 and second region 26 potentially may be formed in a single injection molding operation. As illustrated in FIG. 6, core 12 may be mounted in a conventional injection molding die 42 on a plurality of retractable pins 43, as known to those of ordinary skill in the art. Cover materials then may be injected into the die cavity 44 surrounding core 12. For example, injection of a first material may be accomplished through a plurality, e.g. four, first injection ports 46, and injection of a second material may be accomplished through a second injection port 48. Typically, the retractable pins are retracted when the cover material is in a semi-solid state.

By way of specific example, ninety percent of the cover material, e.g. opaque Surlyn™, may be injected through first injection ports 46. Prior to hardening of the material, a second material, such as generally transparent Surlyn™, may be injected through second injection port 48 to displace the remaining ten percent of cover 14. If an indicia 28 is utilized, the indicia is disposed proximate second injection port 48 to ensure that the generally transparent material displaces the generally opaque material over the subject indicia 28.

It will be understood that the foregoing description is of preferred embodiments of this invention, and that the invention is not limited to the specific forms shown. For example, a variety of materials may be used in the formation of the golf ball cover; a variety of patterns of multiple materials may be used; indicia may be painted on the core, printed on the core, adhered to the core, wrapped about the core, or disposed within the cover material also proximate the core; and the arrangement of materials may be symmetrical or asymmetrical depending on the desired end product. These and other modifications may be made in the design and arrangement of the elements without departing from the scope of the invention as expressed in the appended claims.

What is claimed is:

1. A golf ball, comprising:

a core having an outer surface defining a sphere; and a cover disposed over the core, the cover including a first material and a second, material differing from the first material and alternately placed adjacent to each other, wherein the first material and the second material each extend from said outer surface of the core to a radially outward surface of the cover.

2. The golf ball as recited in claim 1, wherein the first material is opaque and the second material is transparent.

3. The golf ball as recited in claim 2, wherein the second material comprises an ionomer resin.

4. The golf ball as recited in claim 2, wherein the first material comprises a balata material.

5. The golf ball as recited in claim 1, wherein the second material covers less than fifteen percent of the radially outward surface.

6. The golf ball as recited in claim 1, wherein the second material is arranged in a spherically symmetrical pattern.

7. A golf ball, comprising:

a core;

a visible indicia disposed over the core; and a cover placed over the core, wherein the cover is further comprised of a plurality of sections of dissimilar materials in which one of the sections of dissimilar materials is a substantially transparent section over the visible indicia to allow the visible indicia to be clearly visible.

8. The golf ball as recited in claim 7, wherein the substantially transparent section comprises a transparent ionomer material.

9. The golf ball as recited in claim 7, wherein the visible indicia is disposed on the core.

10. The golf ball as recited in claim 7, wherein the substantially transparent section comprises less than approximately ten percent of the cover.

11. The golf ball as recited in claim 7, wherein the substantially transparent section includes a plurality of regions.

12. The golf ball as recited in claim 11, wherein the plurality of regions are arranged in a spherically symmetrical pattern.

13. The golf ball as recited in claim 7, wherein the substantially transparent section is a single region.

14. A golf ball, comprising:

a core; and a cover disposed over the core, the cover including a radially outer surface, wherein the radially outer surface includes at least two distinct regions with each distinct region having a unique material characteristic and extending generally from the core to said outer surface of the core to said radially outer surface of the cover.

15. The golf ball as recited in claim 14, wherein the at least two distinct regions are arranged in a spherically symmetrical pattern.

16. The golf ball as recited in claim 14, wherein the unique material characteristic of a first region comprises a transparent material and the unique material characteristic of a second region comprises an opaque material.

17. The golf ball as recited in claim 14, wherein the unique material characteristic of a first region comprises a harder material and the unique material characteristic of a second region comprises a softer material than that of the first region.

18. The golf ball as recited in claim 17, wherein the unique material characteristic of a first region comprises a softer material and the unique material characteristic of a second region comprises a harder material than that of the first region.

19. The golf ball as recited in claim 14, further comprising an indicia disposed on the core.

20. The golf ball as recited in claim 19, wherein a region disposed over the indicia comprises a transparent material.

* * * * *

United States Patent and Trademark Office

CERTIFICATE OF CORRECTION

PATENT NO : 6,012,992

DATED : January 11, 2000

INVENTOR(S) : Edward Q. Yavitz

It is certified that error appears in the above-identified patent and that said Letters Patent are hereby corrected as shown below:

The title page, showing an illustrative Figure, should be deleted and substitute therefor the attached title page.

Delete Drawing sheets 1-3, and substitute therefor the Drawing Sheets, consisting of Figs. 1-6, as shown on the attached pages.

Signed and Sealed this

Twenty-sixth Day of December, 2000

*Attest:*

Q. TODD DICKINSON

*Attesting Officer*

*Director of Patents and Trademarks*

United States Patent [19]

Yavitz

[11] Patent Number: 6,012,992

[45] Date of Patent: Jan. 11, 2000

[54] GOLF BALL HAVING A COVER WITH VARIABLE CHARACTERISTICS

[76] Inventor: Edward Q. Yavitz, 3828 Spring Creek Rd., Rockford, Ill. 61114

[21] Appl. No.: 09/248,621

[22] Filed: Feb. 11, 1999

[51] Int. Cl.[7] ..... A63B 37/12

[52] U.S. Cl. ..... 473/378; 473/353; 473/374; 473/377; 40/327; 273/DIG. 14

[58] Field of Search ..... 473/372, 373, 473/383, 384, 378, 377, 353, 374; 273/DIG. 14

[56] References Cited

U.S. PATENT DOCUMENTS

| | | | |
|---|---|---|---|
| 3,819,768 | 6/1974 | Molitor | 260/897 |
| 4,431,193 | 2/1984 | Nesbitt | 273/235 |
| 4,998,734 | 3/1991 | Meyer | 273/235 |
| 5,538,794 | 7/1996 | Cadorniga et al. | 428/407 |
| 5,542,680 | 8/1996 | Proudfit et al. | 473/378 |
| 5,631,324 | 5/1997 | Rajagopalan et al. | 473/385 |
| 5,783,293 | 7/1998 | Lammi | 473/373 |

*Primary Examiner*—George J. Marlo
*Attorney, Agent, or Firm*—Fletcher, Yoder & Van Someren

[57] ABSTRACT

A golf ball having a cover made from multiple materials. The golf ball includes a core and a cover disposed over the core. The cover includes a radially outer surface having at lest two distinct regions. Each of the regions includes a unique material having a unique material characteristic. Typically, the golf ball includes an opaque region and a transparent region disposed over an indicia, such as a logo, to provide an interesting visual effect.

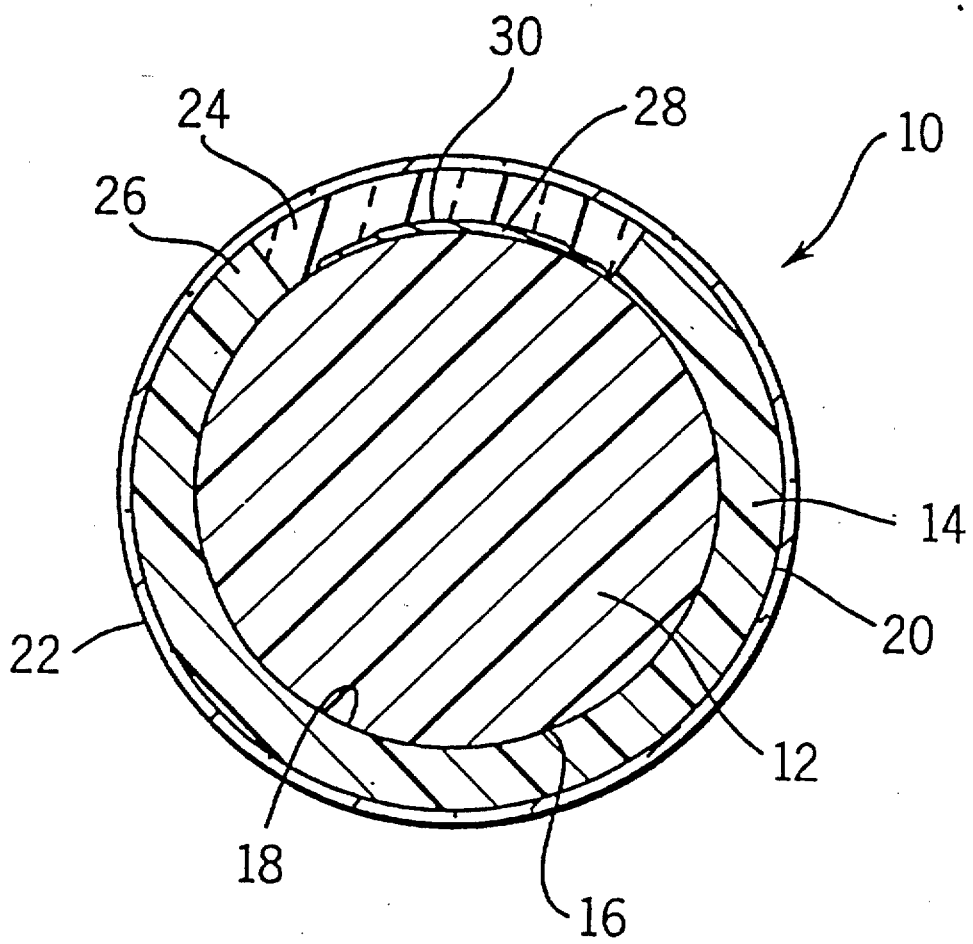

20 Claims, 3 Drawing Sheets